United States Patent [19]

Simpson

[11] 4,442,906

[45] Apr. 17, 1984

[54] PERCUSSIVE DRILLS

[75] Inventor: Frank F. Simpson, Middlesex, England

[73] Assignee: Black & Decker Inc., Newark, Del.

[21] Appl. No.: 322,389

[22] Filed: Nov. 17, 1981

[30] Foreign Application Priority Data

Nov. 18, 1981 [GB] United Kingdom ..... 8036916

[51] Int. Cl.[3] ..... E02D 7/02

[52] U.S. Cl. ..... 173/48; 173/116; 173/133; 173/139; 173/122

[58] Field of Search ..... 173/13, 14, 47, 48, 173/139, 104, 109, 110, 111, 116, 128, 131, 133, 122, 123, 124; 279/75

[56] References Cited

U.S. PATENT DOCUMENTS

| | | | |
|---|---|---|---|
| 3,507,337 | 4/1970 | Chromy | 173/48 |
| 3,791,461 | 2/1974 | Rosselet | 173/48 |
| 3,828,863 | 8/1974 | Bleicher et al. | 173/122 |
| 3,847,229 | 11/1974 | Wanner et al. | 173/122 |
| 3,874,460 | 4/1975 | Schmid et al. | 173/48 |
| 3,921,729 | 11/1975 | Schmuck | 173/104 |
| 4,066,136 | 1/1978 | Wanner et al. | 173/48 |
| 4,109,734 | 8/1978 | Montabert | 173/131 |
| 4,131,165 | 12/1978 | Wanner et al. | 173/139 |
| 4,236,588 | 12/1980 | Möldan et al. | 173/116 |
| 4,284,148 | 8/1981 | Wanner et al. | 173/109 |

FOREIGN PATENT DOCUMENTS

| | | | |
|---|---|---|---|
| 1283769 | 11/1968 | Fed. Rep. of Germany | 173/118 |
| 7810416 | 6/1979 | Netherlands | 173/116 |

*Primary Examiner*—E. R. Kazenske
*Assistant Examiner*—H. Phan
*Attorney, Agent, or Firm*—Harold Weinstein; Edward D. Murphy

[57] ABSTRACT

A percussive drill has a bit holder, a percussive drive including a ram slidably mounted in a hollow piston, and a drive transmission for reciprocating the ram in the piston via an air cushion. The forward travel of the ram during percussive action of the drill is limited by a drill bit or an intermediate member interposed between the drill bit and the ram. A member holds the ram in a position further forward, than that attained during the above limited travel allowed the ram, when percussive action is not desired. The holding member is resilient, has a U shaped cross-section, and is entered by the ram as it moves to the further forward position, the ram then forming a seal therewith, and the member also functioning to absorb the energy of an impact by the ram.

13 Claims, 4 Drawing Figures

PERCUSSIVE DRILLS

FIELD OF THE INVENTION

This invention relates to percussive drills and has particular, but not exclusive, reference to hand-held rotary percussive drills fitted with a control enabling the user to de-couple the percussive drive when required to enable the drill to be used in a rotary mode.

BACKGROUND OF THE INVENTION

In some forms of rotary percussive drill, hammer blows are imparted to a drill bit or other tool either directly or indirectly by a ram reciprocated by a hollow piston through an air cushion formed between the ram and the piston in which the ram is mounted. When the drill is to operate without a hammer action, it has been proposed to allow the ram to move further forward so that a port in the piston is uncovered and the air cushion between the ram and the piston is vented so that although the piston continues to reciprocate the ram does not. Another proposal has been to provide a mechanical latching arrangement of some kind which frictionally engages the ram in its most forward position.

However, it is found that the continuing reciprocation of the piston can lead to the ram continuing to reciprocate, especially if the speed of the drill is infinitely variable so that the forces on the ram are variable and the speed of the drill can coincide with the natural resonant frequency of the reciprocating ram. Such reciprocation is disadvantageous because of the noise and vibration which it produces.

SUMMARY OF THE INVENTION

Accordingly, it is an object of the present invention to provide a construction in which the problem referred to in the preceding paragraph is mitigated.

According to the invention a percussive drill comprises a bit holder, a percussive drive including a ram slidably mounted in a hollow piston, drive means for reciprocating the ram in the piston via an air cushion, the forward travel of the ram during percussive action of the drill being limited by a drill bit or an intermediate member interposed between the drill bit and the ram, and means for holding the ram in a position further forward than said limited travel when percussive action is not desired. The holding means includes a resilient annular hollow-section member which is entered by the ram as it moves to said position further forward, the ram forming a seal therewith, and the resilient member also acting as an energy absorbing buffer for absorbing the energy of an impact by the ram. The hollow-section member may be of "U" shaped cross-section with the limbs of the "U" directed forwards.

The hollow-section member inhibits flow of air out of and into a substantially closed chamber defined in part by the ram and whose volume changes upon movement of the ram.

If the ram begins to reciprocate, the hollow-section member absorbs the impact of the ram and therefore reduces the noise and vibration due to reciprocation of the ram.

BRIEF DESCRIPTION OF THE DRAWINGS

By way of example, an illustrative embodiment of the invention will now be described with reference to the accompanying drawings of which.

DETAILED DESCRIPTION OF THE PREFERRED EMBODIMENT

Figure 1:
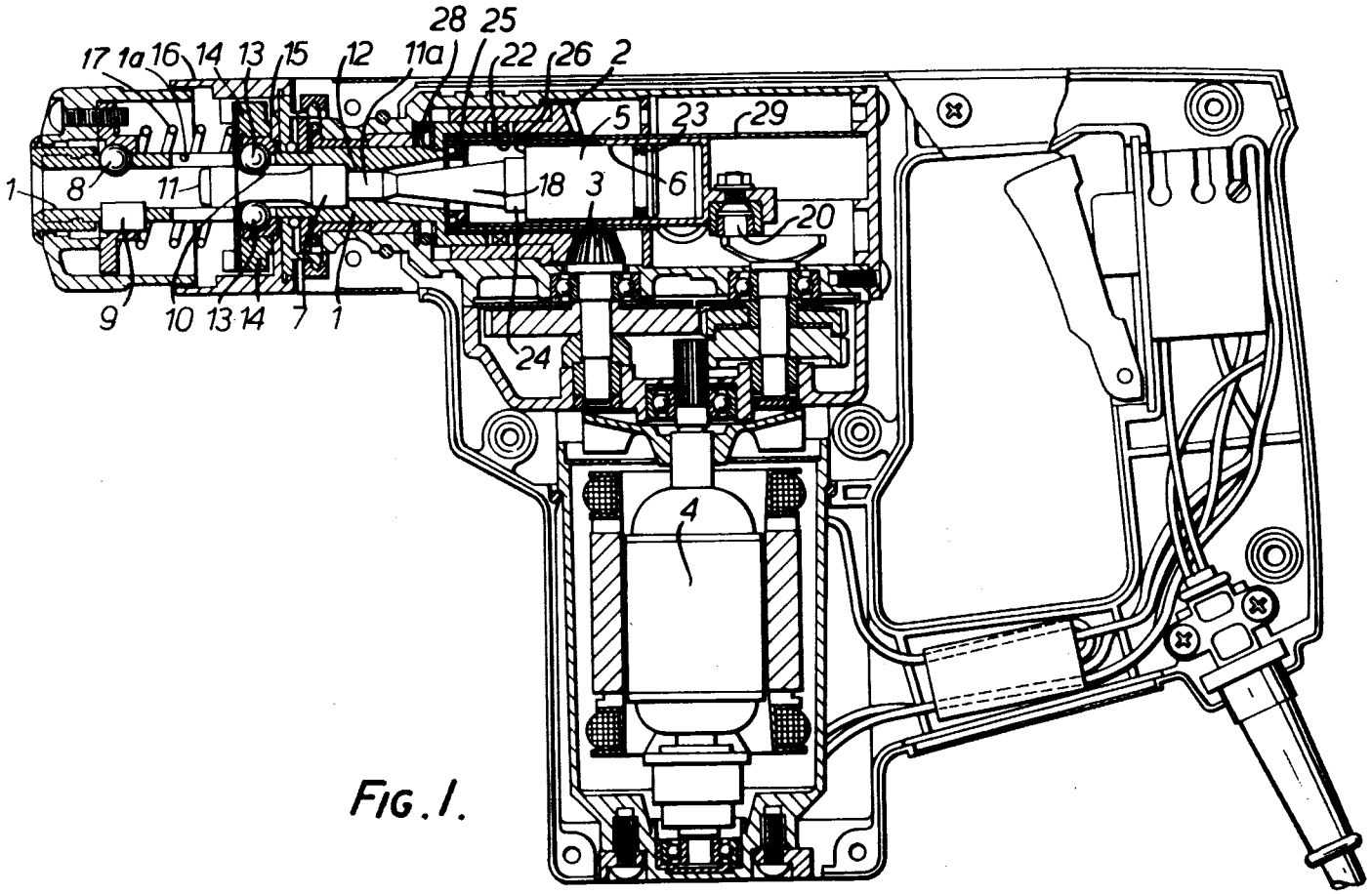
FIG. 1 is a cross-sectional side view of a rotary percussive drill.

The rotary percussive drill has a bit holder in the form of a tubular sleeve 1, one end of which has teeth 2 which engage a bevel gear 3 through which rotation about its longitudinal axis is imparted to the sleeve 1. The bevel gear 3 is driven by an electric motor 4 of infinitely variable speed. The motor 4 also provides a percussive drive through the medium of a pneumatically actuated ram 5 reciprocable in a hollow piston 6. As will be described more fully later the motor 4 reciprocates the piston 6 which, in the hammer mode, reciprocates the ram 5, the nose 18 of the ram striking a beat piece 7.

The beat piece 7 is movable along the bore of the sleeve 1 and is located between the ram 5 and a bit (not shown). The bit is held in the sleeve 1 by releasable locking balls 8 and is rotatable by the sleeve 1 via driving elements one of which is indicated at 9.

The beat piece 7 has two diametrically opposed axial recesses 10 located between the nose 11 of the beat piece and an end portion **11*a* which is of reduced diameter as compared with the remainder of the beat piece and which is located in a smaller diameter bore 12 of the sleeve 1**.

The recesses 10 accommodate locking elements in the form of balls 13 that locate permanently in the recesses 10 and engage the surface of an annular holder 14 maintained in contact with the face 15 of a mode change control member 16, of generally tubular form, by a helical spring 17.

With the above-described components in the positions shown in FIG. 1, with the bit being pressed against a work piece, the beat price 7 is, in use, cyclically impacted by the nose 18 of the ram 5 as the latter is reciprocated in the hollow piston 6, and those impacts are transferred by the beat piece 7 to the bit. At the same time, the sleeve 1 is rotated about its longitudinal axis by the drive transmitted to gear 3 and this rotation is transferred to the bit by the driving elements 9.

The hollow piston 6 is driven by a crank 20 rotated via gearing by the motor 4. The piston 6 has a stepped bore, the inner portion 21 (see particularly FIGS. 2A, B and C) of the bore being narrower than the outer portion 22 and the rear end of the ram 5 has a seal 23 which seals against the inner portion 21 of the bore but not against the outer portion 22. In the hammer mode of the drill, even when the ram is in its most forward position (the position shown in FIG. 1) the rear end of the ram is still retained in the inner portion 21 of the bore, and therefore a closed chamber is defined behind the ram 5. This closed chamber provides an air cushion by which the ram 5 is reciprocated when the piston 6 is reciprocated.

If now the user wishes to use the drill in the non-hammer mode, the mode change control member 16 is rotated so moving the balls 13 to the left as seen in the drawing and along the slots **1*a* and the recess 10. The balls 13 contact the left-hand (as seen in the drawing) end of the recess 10, and continued rotation of the member 16 moves the beat piece 7 to the left (as seen in the drawing) by an amount sufficient to provide clearance between the end 11*a* and the nose 18 of the ram 5 when the latter is at the end of its impacting stroke. When in this position, the beat piece 7** is not impacted by the nose of the ram and the bit is subject only to rotary movement.

Figure 2A:
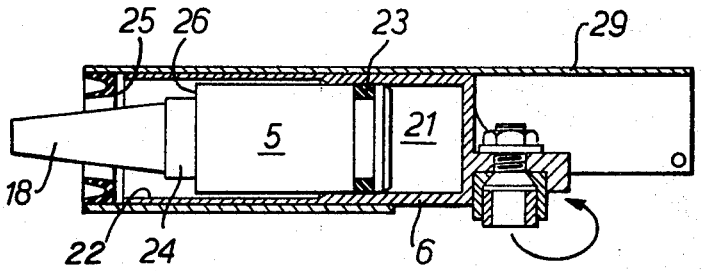
FIGS. 2A to 2C are cross-sectional side views of the percussive mechanism of the drill in various positions.

With the beat piece 7 out of the path of the ram 5, the ram is able to advance further forward. FIG. 2A shows the ram in its most forward position when the tool is in the percussive mode. If the tool is now put in the non-percussive mode, the ram is able to advance through the position shown in FIG. 2B to the position shown in FIG. 2C in which the ram is at its most forward position. As the ram passes the position shown in FIG. 2B, the nose 18 of the ram enters the sleeve 1 and a reduced diameter forward portion 24 of the ram enters an annular seal 25 of "U" shaped cross-section, with a shoulder 26 of the ram abutting the rear end of the seal 25. The seal 25 is fixed to a stationary guide tube 29 in which the piston is reciprocally mounted. The rear end of the ram enters the outer portion 22 of the bore. Also a port (not shown) is provided in the piston 6 at a location such that with the ram in the position shown in FIG. 2C, the port is to the rear of the ram and the air cushion is vented.

Figure 2B:
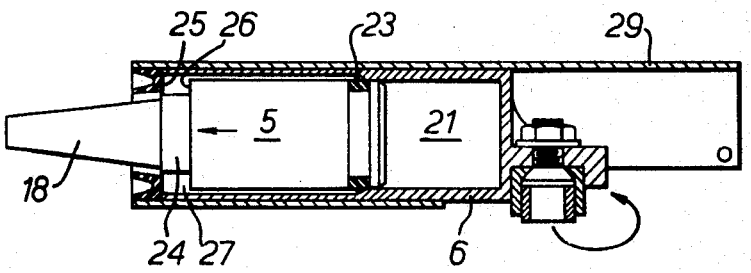
Figure 2C:
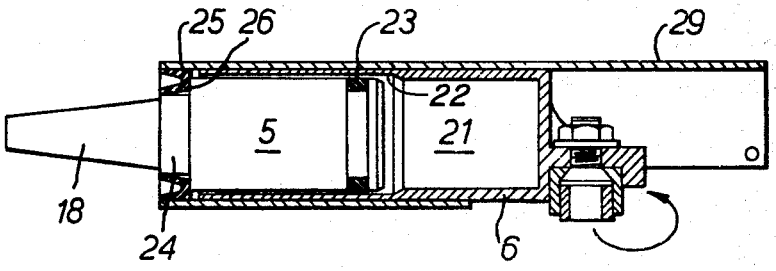

The provision of such a port has previously been proposed in order that with the ram in the position shown in FIG. 2C, the air cushion is vented and the piston reciprocates with the ram remaining in its forward position. We have found, however, that despite the use of the port to provide venting, there is a tendency at some speeds of rotation of the motor for the ram to reciprocate in the non-hammer mode. Although the ram does not strike the beat piece, so that there is no hammer action, this reciprocation is disadvantageous in that it creates a vibration.

In the drill shown in the drawings such vibration is inhibited. There are several ways in which the vibration is inhibited and these are primarily as follows:

(a) as the forward portion 24 of the ram enters the seal 25, during its movement from the position shown in FIG. 2B into the position shown in FIG. 2C a substantially closed chamber 27 is formed at the front of the ram, and excess pressure in this chamber is vented through the seal 25 whose "U" shaped cross-section facilitates such venting; the air trapped in the chamber 27 damps the forward movement of the ram;

(b) the seal 25 acts as a buffer and absorbs the impact of the shoulder 26 of the ram; upon impact the seal 25 is deformed towards a wall 28 on the sleeve 1 (see FIG. 1) and air is expelled from behind the seal; recovery of the seal is retarded;

(c) since the rear end of the ram is in the outer portion 22 of the bore of the piston, there is a clearance between the ram and the piston; this clearance substantially eliminates frictional drag on the ram when the piston 6 is retracted; also, the clearance provides further venting of the air cushion behind the ram.

In addition to the factors listed above there is also a frictional force between the seal 25 and the portion 24 which tends to retain the ram in the position shown in FIG. 2C.

With the arrangement shown in the drawings, we have found that when the drill is switched to the non-hammer mode, the ram advances ito its forward position shown in FIG. 2C, and although at some speeds the ram may continue to reciprocate either for a short time or even continually, because of the energy absorbed during each stroke of the ram, the amplitude of the reciprocation is much reduced and vibration therefore virtually eliminated.

To revert to the hammer mode, the control member 16 is rotated in the reverse direction so allowing the balls 13 to return, under the action of spring 17, to the position shown in FIG. 1 and, when the user presses the bit against a work piece, the beat piece is returned to its active position shown in FIG. 1 and presses the ram 5 back into the position shown in FIG. 1, whereupon the hammer action re-starts.

The cam face may be so contoured that a 90° or 180° rotation of the control member 16 is needed to complete the required axial movement of the balls 13 along the slots 1*a*. The contour of the cam face may, alternatively, be such that further rotation of the member 16 in the same direction allows the balls 13 to be returned to their original positions.

It will be appeciated that members of shapes other than spherical may be used in place of the balls 13, and that the beat piece may have a separate axial recess 10 for each such member whether it is a ball or not.

In addition, the control member 16 may be adapted to be moved axially and not rotated to effect the change between the hammer and non-hammer modes.

Also it will be understood that, in the above described embodiment, the bit is subjected to percussive action of the beat piece only when the bit is pressed by the user against a work piece. Such pressure against the work piece results in a small inward movement of the bit into the sleeve, and of the beat piece towards the ram. When a user operates the drill in the hammer mode but without pressing the bit against a work piece, the bit and the beat piece move outwards as a result of impacting from the ram until the beat piece is out of range of the ram, whereupon the ram adopts the position shown in FIG. 2C and ceases to reciprocate.

What is claimed is:

1. A percussive drill, comprising:

a bit holder;

a percussive drive including a ram slidably mounted in a hollow piston;

drive means for reciprocating the ram in the piston via an air cushion formed between said piston and said ram, the forward travel of the ram during percussive action of the drill being limited by a drill bit or an intermediate member interposed between the drill bit and the ram;

a resilient annular hollow-section member for holding the ram, when percussive action is not desired, in a position further forward than the forward travel to which the ram is limited during percussive action;

said resilient annular hollow-section member being entered by the ram as the latter moves to said position further forward and the ram forming a seal with said hollow-section member, the latter also absorbing the energy of an impact by the ram thereagainst; and said piston having a forward portion of wider internal cross-section than a rear portion of said piston and in which rear portion said ram reciprocates during percussive action of the drill, and said ram being located fully in said forward portion in said position further forward whereby the air cushion between the piston and the ram is vented.

2. The percussive drill as claimed in claim 1, wherein the drill is a rotary percussive drill including transmission means for transmitting rotation from a motor to a tool bit.

3. The percussive drill as claimed in claim 2, further comprising mode change means for changing the drill from a state in which percussion is transmitted to the bit to a state in which percussion is not transmitted to the bit.

4. The percussive drill as claimed in claim 2, wherein the hollow-section member is of "U" shaped cross section with inner and outer limbs directed in the forward travel direction of said ram, whereby one of said limbs is disposed radially outwardly of the other of said limbs.

5. The percussive drill as claimed in claim 4, wherein the radially outer limb of the hollow-section member is fixed to a stationary part of the drill.

6. The percussive drill as claimed in claim 4, wherein the piston is mounted for reciprocation in a stationary guide tube to which the radially outer limb of the hollow-section member is fixed.

7. A percussive drill, comprising:

a bit holder for receiving a tool bit;

a stationary guide tube;

a hollow piston mounted for reciprocation in said guide tube;

a ram slidably mounted in said hollow piston;

transmission means for reciprocating said hollow piston and in said guide tube with consequential reciprocation of said ram in said hollow piston via an air cushion formed in said hollow piston between a portion of said piston and said ram, forward travel of said ram being limited during percussive action of the drill by the engagement of the tool bit with a workpiece;

said ram having a reduced diameter forward portion extending forwardly from an outwardly extending, forwardly facing shoulder formed on said ram;

a resilient annular hollow-section seal of "U" shaped cross section with inner and outer limbs being orientated forwardly, one of said limbs being disposed radially outwardly of the other of said limbs, and the radially outer limb being fixed to said guide tube;

said annular seal holding said ram, when percussive action is not desired, in a further forward position than that obtained during limited forward travel of said ram during said percussive action; and said forward portion of said ram entering said annular seal and engaging with the radially inner limb thereof and a closed chamber being formed between said annular seal and said shoulder as said ram moves towards said further forward position, and said shoulder abutting said annular seal when said ram reaches said further forward position;

whereby air trapped in said chamber dampens the forward movement of said ram to said further forward position, and any excess air pressure created in said chamber is vented through said annular seal whose "U" shaped cross-section and orientation facilitates such venting.

8. The percussive drill of claim 7, wherein said bit holder comprises a tubular sleeve; and further comprising a beat piece located in said sleeve and movable therein, said beat piece being disposed between said ram and the tool bit and being acted upon by said ram during said percussive action.

9. The percussive drill of claim 8, further comprising a mode change control member mounted for adjustable rotation about said sleeve, said sleeve having a slot therein along which a locking element is movable by rotation of said control member, and said beat piece having a longitudinal recess therein which is engaged by said locking element, whereby said beat piece can be moved to an inoperative position for changing to a non-hammer mode of the drill.

10. The percussive drill of claim 8, wherein said sleeve has a wall towards which said seal is deformed upon impact of said shoulder against said seal and air is expelled from behind said seal, whereby recovery of the deformed seal is retarded.

11. A percussive drill, comprising:

a bit holder for releasably receiving a tool bit;

a hollow piston mounted for reciprocation in the drill;

a ram slidably mounted in said hollow piston;

a transmission for reciprocating said hollow piston with consequential reciprocation of said ram in said hollow piston via an air cushion formed in said hollow piston between a portion thereof and said ram, forward travel of said ram being limited during percussive action of the drill by the engagement of the drill bit with a workpiece;

said hollow piston having a stepped bore with a forward portion of larger diameter than that of the rear portion of said stepped bore, said ram having a circumferential seal which forms a seal with said rear portion but not with said forward portion, there being a clearance between the ram and the piston when said ram is in said forward portion, said clearance eliminating frictional drag on said ram when said hollow piston is retracted and also facilitating venting of said air cushion when said ram moves forwardly from said rear portion into said forward portion;

said ram having a reduced diameter portion extending forwardly from a forwardly facing shoulder formed on said ram;

a resilient annular hollow-section member of "U" shaped cross section with inner and outer limbs being oriented forwardly and whereby one of said limbs is disposed radially outwardly of the other of said limbs;

said annular member holding said ram, when percussive action is not desired, in a position further forward than that attained during limited forward travel of said ram during said percussive action, said ram being fully located in said stepped bore forward portion when in said position further forward;

said reduced diameter portion of said ram entering said annular member and frictionally engaging the radially inner limb of said annular member as said ram moves into said position further forward, and said shoulder abutting said annular member when said ram reaches said position further forward; and a closed chamber being formed between said annular member and said shoulder as said ram moves towards said position further forward, whereby air trapped in said chamber dampens the forward movement of said ram and the annular member and orientation of said annular member facilitates venting past said annular member of any excess air pressure created in said chamber.

12. The percussive drill of claim 11, further comprising a guide tube in which said hollow cylinder reciprocates, and wherein the radially outer limb of said annular member is fixed to said guide tube.

13. The percussive drill of claim 12, wherein said bit holder comprises a sleeve having a bore therethrough for receiving the tool bit, said sleeve bore having a reduced diameter portion; and further comprising a beat piece disposed in said sleeve and positioned between said ram and the tool bit, said beat piece having a rear end portion of reduced diameter which is located in said reduced diameter portion of the bore of said sleeve.

* * * * *